US008307905B2

(12) United States Patent
Bjorgum

(10) Patent No.: US 8,307,905 B2
(45) Date of Patent: Nov. 13, 2012

(54) ACTIVATING MECHANISM

(75) Inventor: Stig Ove Bjorgum, Voss (NO)

(73) Assignee: Vosstech AS, Voss (NO)

( * ) Notice: Subject to any disclaimer, the term of this patent is extended or adjusted under 35 U.S.C. 154(b) by 274 days.

(21) Appl. No.: 12/675,120

(22) PCT Filed: Sep. 15, 2008

(86) PCT No.: PCT/NO2008/000330

§ 371 (c)(1),
(2), (4) Date: Mar. 2, 2010

(87) PCT Pub. No.: WO2009/041823

PCT Pub. Date: Apr. 2, 2009

(65) Prior Publication Data

US 2010/0236793 A1 Sep. 23, 2010

(30) Foreign Application Priority Data

Sep. 14, 2007 (NO) ..... 20074696

(51) Int. Cl.
*E21B 29/00* (2006.01)

(52) U.S. Cl. ..... 166/386; 166/319; 166/102

(58) Field of Classification Search ..... 166/386, 166/319, 192, 372, 376, 102
See application file for complete search history.

(56) References Cited

U.S. PATENT DOCUMENTS

| | | | | |
|---|---|---|---|---|
| 5,607,017 | A | 3/1997 | Owens et al. | |
| 6,433,991 | B1 | 8/2002 | Deaton et al. | |
| 6,554,062 | B1 | 4/2003 | Dewey et al. | |
| 2007/0272410 | A1 * | 11/2007 | Hromas et al. | 166/298 |

FOREIGN PATENT DOCUMENTS

| | | |
|---|---|---|
| EP | 0681087 | 9/2000 |
| WO | WO 2005/049961 | 6/2005 |

* cited by examiner

*Primary Examiner* — David Andrews
*Assistant Examiner* — Ronald Runyan
(74) *Attorney, Agent, or Firm* — Christian D. Abel

(57) ABSTRACT

The present invention relates to an activating mechanism (200) for guiding and controlling a downhole tool (100) and/or subsea equipment employed in connection with recovery of hydrocarbons. The activating mechanism (200) comprises an annular sleeve (21) provided with non-through-going recesses (22, 24) in the material of the annular sleeve (21), where separate replaceable elements are provided in the recesses (22, 24) to act as a pump (P), piston (S1), reservoirs (R1, R2), movable slide (S2) and pistons (25*a*, 25*b*), where these elements create a closed fluid circuit which on being subjected to a number of cyclical loads will open up a connection between the pistons (25*a*, 25*b*). A method for controlling the activating mechanism (200) is also presented.

10 Claims, 7 Drawing Sheets

ACTIVATING MECHANISM

Figure 1A:
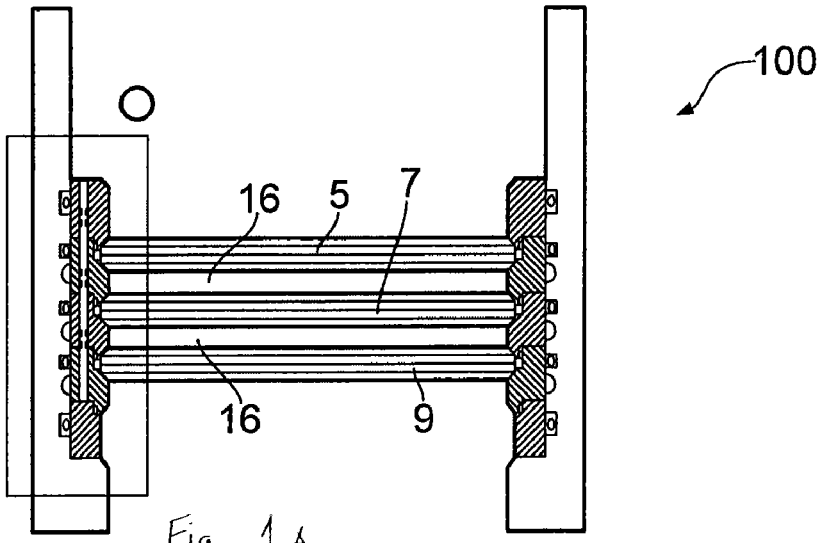
Fig 1 A Prior Art

The present invention relates to an activating mechanism for subsea equipment and/or downhole tools employed in connection with recovery of hydrocarbons, where the activating mechanism according to the present invention is employed in a special embodiment for controlling disintegration of a sealing device in a well. The invention also relates to a method for deploying and disintegrating the sealing device located in the well.

In connection with exploration and recovery of hydrocarbons offshore and onshore, various tools and equipment are employed, where these tools and/or equipment can be guided and controlled from a non-active/active to an active/non-active position by means of an activating mechanism such as electrical signals, explosive charges, hydraulics, pneumatics or the like. Examples of these tools and/or equipment may include various types of valves, well plugs, etc. Since serious consequences for both the environment as well as costs may be involved if a valve or a plug, for example, opens accidentally, or remains closed when it should open, it is vital that the activating mechanism used for steering or controlling subsea equipment and/or downhole tools should be reliable and work properly.

An example of this which is well known within the oil industry is where a well or a formation in the well has to be shut down during its lifetime for various reasons. This may occur, for example, when different zones in the well have to be isolated from one another, when one or more fluids have to be injected into the well, during perforation of pipes in the well, cementing of the well and a number of other operations. For this purpose one or more plugs (so-called well plugs) are generally employed to perform this shutdown, where the plug or plugs must be capable of withstanding high pressure, high temperature, and possibly also a corrosive environment which is present in such a well.

These plugs may either be retrievable or permanent, the well conditions, which operation(s) has to be conducted etc. determining whether one type of plug or the other should be used.

After use the retrievable plugs are recovered from the well by means of mechanical devices, which may be, for example, wirelines, slick lines or coiled tubing. These plugs, however, have a tendency to become stuck, particularly if they are left for too long in the well. The plugs may also become deformed due to the great pressure to which they are exposed, with the result that they cannot be recovered from the well without substantial effort.

When using permanent plugs, these can be completely or partly destroyed by means of different mechanisms. Plugs of this type may be made of a soft or reactive material, such as rubber, composite materials, etc., where the material can either be broken down or perforated by suitable means, thereby admitting a flow through the pipe or the well. For example, after a pressure testing of a well is completed, a chemical may be added to the well which decomposes the rubber plug when the plug is to be removed. However, a great deal of uncertainty will be associated with when the plug has been "removed", and whether it is completely or only partly "removed".

Permanent plugs may also be made of a brittle material, where after the desired operation or operations have been performed, the plug is shattered by means of suitable methods and mechanisms.

The use of such plugs is well known, where they may be made of ceramic material, glass, etc. and glass in particular is considered to be highly suitable within the oil industry. Glass is almost inert with regard to all types of chemicals and is without risk for the personnel handling the plug. The glass's properties also enable it to retain its strength at high temperatures and it can remain in an oil well for a very long time without suffering damage or being broken down.

With the known solutions, a plug such as that mentioned above is removed by means of an explosive charge, with the result that the glass is shattered into small particles which are easily washed out of the well without leaving residue which could be harmful. These explosive charges may be incorporated in the actual plug or mounted above the actual plug. The actual detonation is remotely controlled and can be triggered from the surface of the well.

An example of a glass test plug, where the plug is arranged to be able to be removed by means of an explosive charge, is known from NO B1 321.976. The plug comprises a number of laminated or stratified ring disks of a given thickness, which are located on top of one another. Between the different layers in the plug an intermediate film of plastic, felt or paper is inserted; the various glass layers may also be joined by laminating with an adhesive, such as glue. During use the plug will be mounted in a plug-receiving chamber in a pipe, for example a production tubing, where the underside of the plug rests in a seat at the bottom of the chamber. An explosive charge is further incorporated in the top of the plug, one or more recesses being drilled out of the top of the plug, in which recesses the explosive charge(s) is placed.

The use of explosive charges for disintegration of test plugs can provide a safe and calculable removal of the plug. In many countries, however, extremely stringent requirements are placed on the use and importation of explosives, thus making it desirable to produce a solution where the test plug can be removed in a controllable manner and without the use of such means.

It is therefore an object of the present invention to provide an activating mechanism for a downhole tool and/or subsea equipment used in an oil well, where the downhole tool and/or the subsea equipment may be hydraulically or pneumatically operable. In some cases another type of medium may also be employed for operating the downhole tool and/or the subsea equipment.

The activating mechanism according to the present invention is particularly intended for use in controlling disintegration of a sealing device in an oil and/or gas well.

It is a further object of the present invention to provide an activating mechanism which can activate or deactivate a downhole tool and/or subsea equipment in an oil and/or gas well in a safe and reliable manner, where the activating mechanism can be controlled by means of cyclical pressure loads applied to the activating mechanism.

It is a further object of the present invention to provide an activating mechanism which can be installed together with the downhole tool or the subsea equipment which has to be employed, or which can also be retrofitted on already-existing solutions.

Yet another object of the present invention is to provide an activating mechanism which attempts to avoid or at any rate reduce the disadvantages of existing activating mechanisms.

These objects are achieved with an activating mechanism according to the attached claims, where further details of the invention will become apparent from the following description.

In a preferred embodiment the activating mechanism according to the present invention is particularly intended for use together with a disintegratable well plug, but it should be understood that the activating mechanism may also be employed for guiding or controlling other types of downhole tools and/or subsea equipment, such as valves, opening/closing of various couplings, etc.

A well plug of this kind may, for example, be used in connection with testing of production wells. The well plug comprises a sleeve-shaped element, where the sleeve-shaped element encloses a number of degradable strata and supporting bodies in a radial and a longitudinal direction of a pipe. By means of this construction, consisting of alternate layers of supporting bodies and strata, closed chambers will be formed between the strata. These chambers are filled with fluid such as water, oil or another suitable fluid. The degradable strata are sheets which may be made of glass, ceramic material or the like.

The sleeve-shaped element may be placed in a housing, where the housing may further be placed internally in a production tubing or also a casing. In a second embodiment the housing may also form a part of a tubing or as a third alternative the sleeve-shaped element may be employed without a surrounding housing. In this embodiment, however, the different parts must be interconnected in a suitable manner to prevent the plug from falling apart.

The sleeve-shaped element also comprises a body, where the body comprises at least one hydraulic slide valve. The body may be rearranged to form a connection between the closed fluid-filled chambers and one or more recesses forming a relief chamber in the well plug. When a connection is provided between the chambers and the relief chamber, fluid from the fluid-filled chambers can flow from the chambers into the relief chamber, whereby the chambers are emptied and the glass strata are "weakened".

In order to rearrange the body in the sleeve-shaped element, an activating mechanism is employed. This activating mechanism comprises an annular sleeve, where the annular sleeve may be integrated in the actual well plug, or it may be a separate part which can be connected with the well plug in a suitable manner. In an alternative embodiment it is also possible to envisage the activating mechanism located at a distance from the well plug. The object of the activating mechanism is to be able to conduct the disintegration of the well plug in a controlled manner.

When the well plug is used for shutting down a well which is to be pressure-tested, the well plug and the activating mechanism are lowered as a joint unit or separately down to the desired area and then placed, for example, in a plug-receiving chamber or in some other way in a tubing. Pressure and/or other required tests are then conducted.

The well plug and the activating mechanism may, for example, be connected by means of a threaded connection, where the activating mechanism may be attached either externally or internally to the well plug's sleeve-shaped element, or "rapid couplings" of various kinds, bolts, etc. may also be employed. It should be understood, however, that the well plug and the activating mechanism may also be provided as an integrated unit.

The actual activating mechanism is produced by providing a number of recesses on an outer surface (i.e. the material) of the annular sleeve, these recesses being distributed round the whole or parts of the annular sleeve's internal or external circumference. The recesses may be arranged in several layers or levels and they may furthermore be arranged in specific "patterns" or also be more arbitrarily arranged. Two adjacent recesses may moreover be interconnected via one or more closed channels or bores extending between the recesses. The recesses will furthermore be provided so that they do not pass through the material, with the result that the recesses do not form a through-going hole extending from the annular sleeve's external surface to an internal surface of the ring.

In the annular sleeve's recesses there are provided elements which act as pistons, pumps, valves (regulating, non-return, safety valve, etc.) and reservoirs for a fluid. The elements are manufactured as separate units and can therefore be mounted in or removed from the annular sleeve's recesses by means of a suitable tool. In the annular sleeve's upper and lower end surfaces, moreover, an unbroken or broken annular recess is provided, in which recess one or more closed pistons are mounted. The recesses in the end surfaces will thereby extend for some length into the sleeve's axial direction. A number of the closed pistons mounted in the upper and lower end surfaces of the annular sleeve may be different here, and it may be envisaged, for example, that the whole recess in the upper end surface may act as a closed piston, while four closed pistons may be mounted in the lower end surface, but in some embodiments of the activating mechanism an equal number of closed pistons may also be mounted in the upper and lower end surfaces.

One or more of the above-mentioned elements contains a hydraulic fluid or the like. Since these different elements are interconnected via closed channels or bores, a closed, hydraulic circuit will be created. Since the annular sleeve is exposed to repeated and controlled applied cyclical fluid pressure fluctuations, the location of the elements will cause a certain amount of fluid to be fed by means of a pump and a piston through the closed channels or bores to one or more reservoirs containing a slide and possibly also a quantity of a fluid, whereby with each load, this cyclical load causes the slide to be moved a specific distance in the annular sleeve's axial direction. After a number of cyclical pressure fluid fluctuations, the slide will have moved to a point in the reservoir where it permits the slide to open, allowing the closed hydraulic circuit to be influenced by a well pressure. In the present invention the term reservoir should be understood to refer to a cavity, a cylinder or the like containing a medium such as fluid, gas, etc.

Thus when the well plug requires to be broken down, the tubing, which is filled with a fluid, will be subjected to a number of controlled and high cyclical compressions from the top of the well, for example from a platform or vessel, where these compressions will "propagate" downwards in the tubing. Since the annular sleeve's internal surface is subjected to these cyclical loads, this will cause the annular sleeve to be slightly expanded in its radial direction with each load. This expansion of the annular sleeve's circumference will thereby cause at least one pump mounted in the annular sleeve's recess(es) to deliver with each such expansion a certain amount of fluid to one or more reservoirs provided in the sleeve's recesses. In these reservoirs there are mounted movable slides, whereby each cyclical load will cause the slides to be moved a given distance in the annular sleeve's axial direction. Since these reservoirs with associated slides are in fluid connection with one or more closed pistons mounted in annular recesses in the annular sleeve's upper and lower edges, where the upper closed pistons will furthermore be subject to the pressure existing on the top of the well plug, in a given position the slides will permit hydraulic fluid, which is provided in the upper closed piston or pistons and is influenced by the well pressure, to flow past the slide valve and press down or out one or more closed pistons mounted in the recess in the lower edge of the annular sleeve. Since this or these lower closed pistons are connected with the body in the well plug, the body in the well plug will be subjected to an influence from the piston/pistons and thereby moved in relation to the sleeve-shaped element, this movement thereby forming a connection between the closed fluid-filled chambers and the recesses in the well plug. This connection, which is a discharge channel, is provided in the supporting bodies. When a connection is established, fluid from the fluid-filled chambers can thereby flow out through the discharge channel into the recesses, whereby the pressure differences between the two chambers will be equalised. Since the glass strata are now no longer supported by the fluid in the fluid-filled chambers, by means of this action they may be exposed to such a large load that they are shattered. In an embodiment, when an equalised pressure has been achieved between the two chambers, the body may also be provided in such a manner that a pin device firstly point loads the upper glass stratum in the well plug, with the result that the glass stratum is shattered on account of the pressure and the point loading to which it is subjected. This is repeated for each glass stratum, with the result that all the glass strata will finally be shattered, thereby admitting fluid flow through the well plug. The body may comprise at least one hydraulic slide valve, more preferred two slide valves, where one slide may be controlled with regard to uncovering the discharge channels, thereby forming a connection between the fluid-filled chambers and the recesses, while the other slide valve may be used to control movement of the pin devices. The activation of the two slide valves may be jointly controlled or it may be controlled separately. In this way the body can be operated in a controlled manner so that the glass strata are disintegrated one after the other with the certainty that the whole well plug will be disintegrated.

In order to provide a safe and reliable activating mechanism, one or more "auxiliary fluid circuits" may be provided in the activating mechanism. Where the main fluid circuits fail to deliver a sufficient amount of fluid, the "auxiliary fluid circuits" will ensure that the amount of fluid required to implement disintegration of a well plug is provided.

Thus by means of the present invention an activating mechanism for a well plug is provided, where the well plug is not disintegrated accidentally, and furthermore where it can be accurately determined when the disintegration will occur and where the well plug together with the activating mechanism provide far greater flexibility with regard to construction, use and reliability of such well plugs.

Other advantages and special features of the present invention will become apparent from the following detailed description, the attached drawings and the following claims.

Figure 1B:
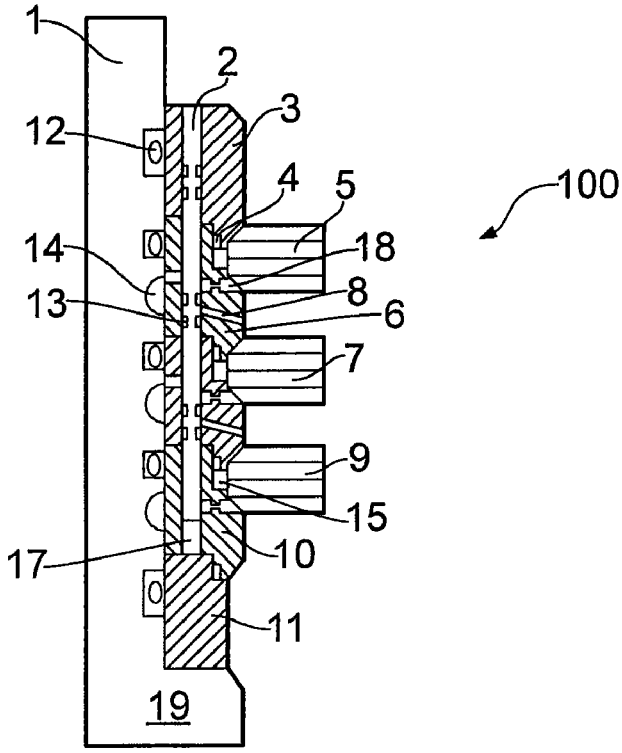
Fig. 1B PRIOR ART
Figure 2:
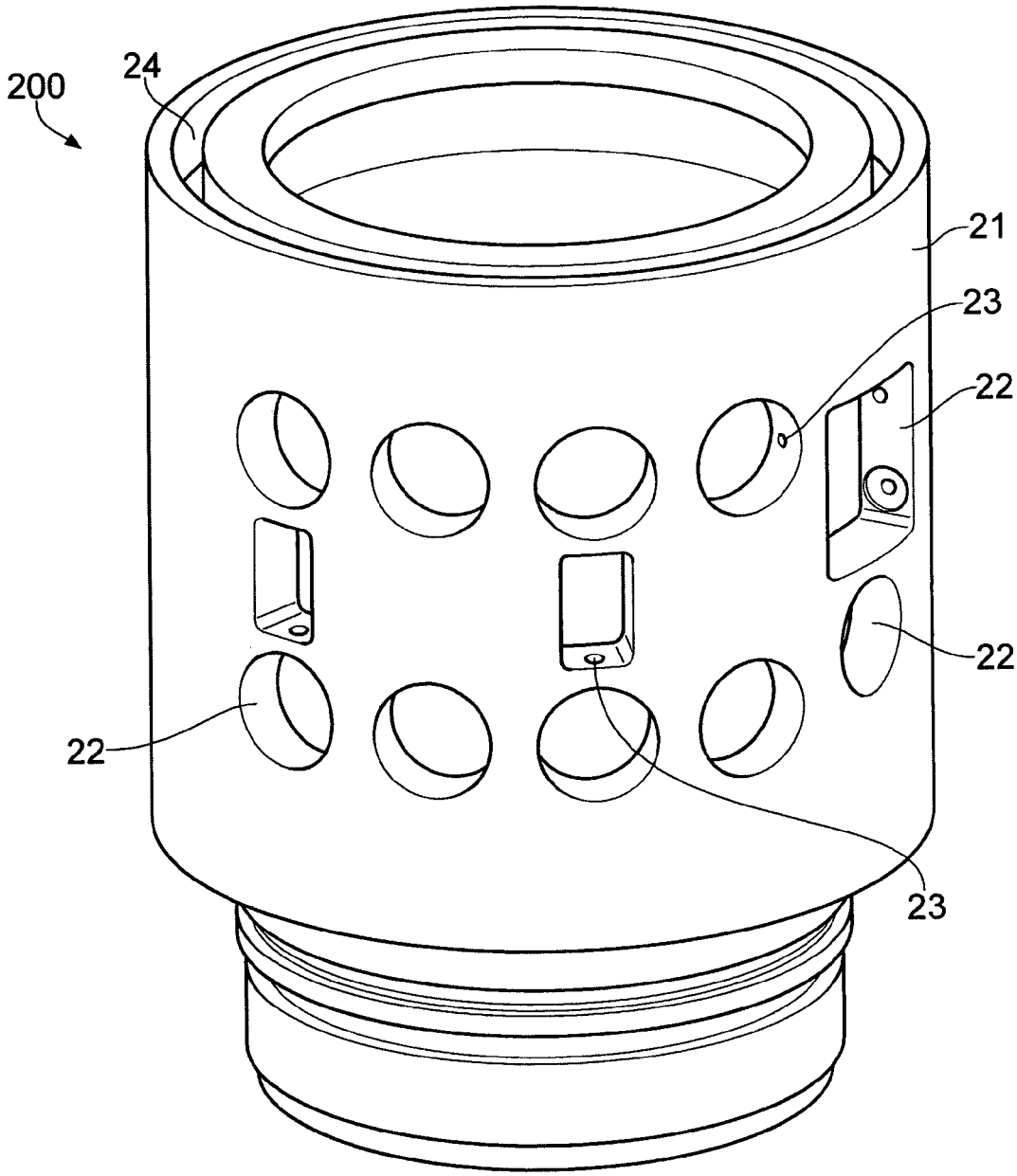
Figure 3:
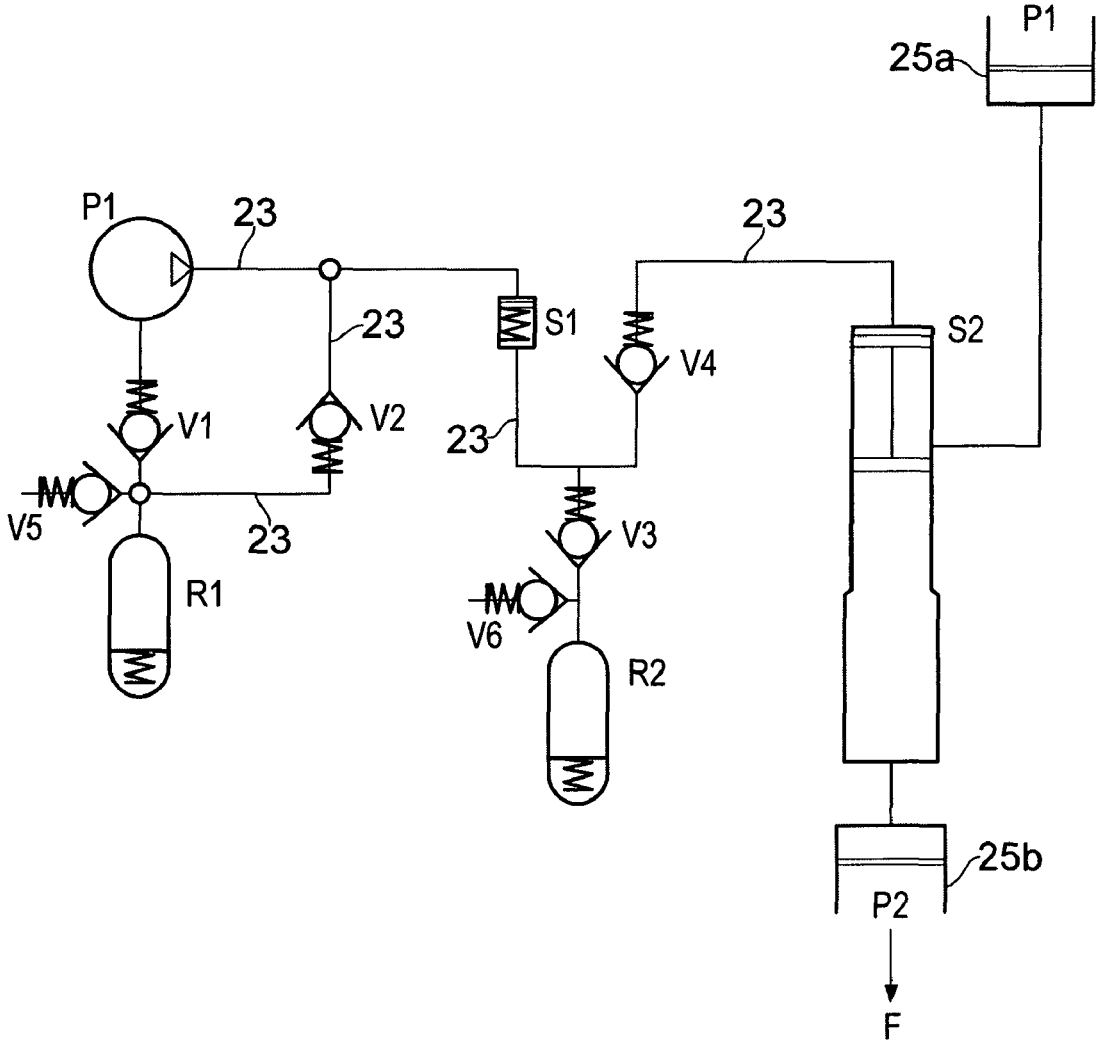
Figure 4:
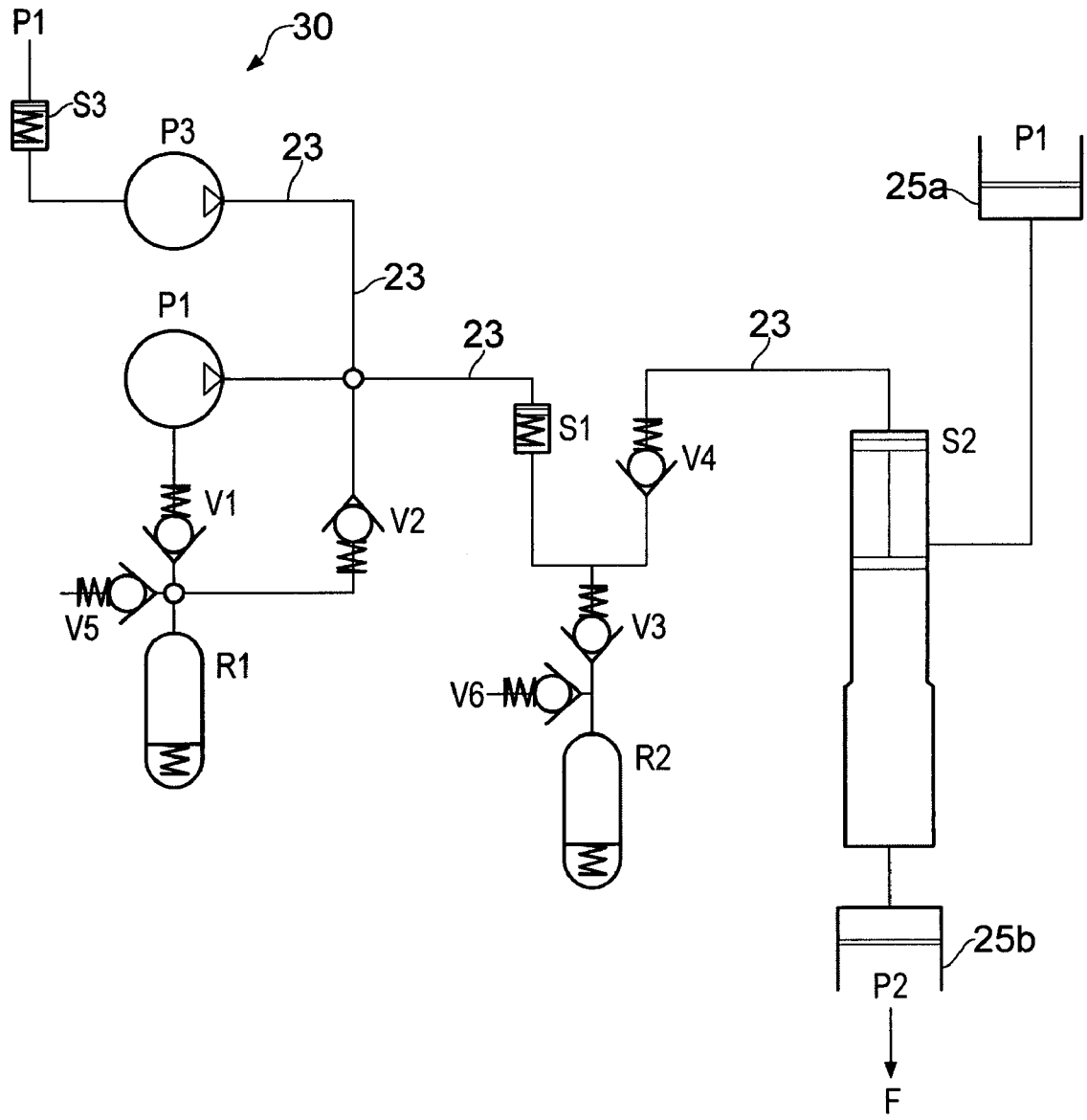
Figure 5:
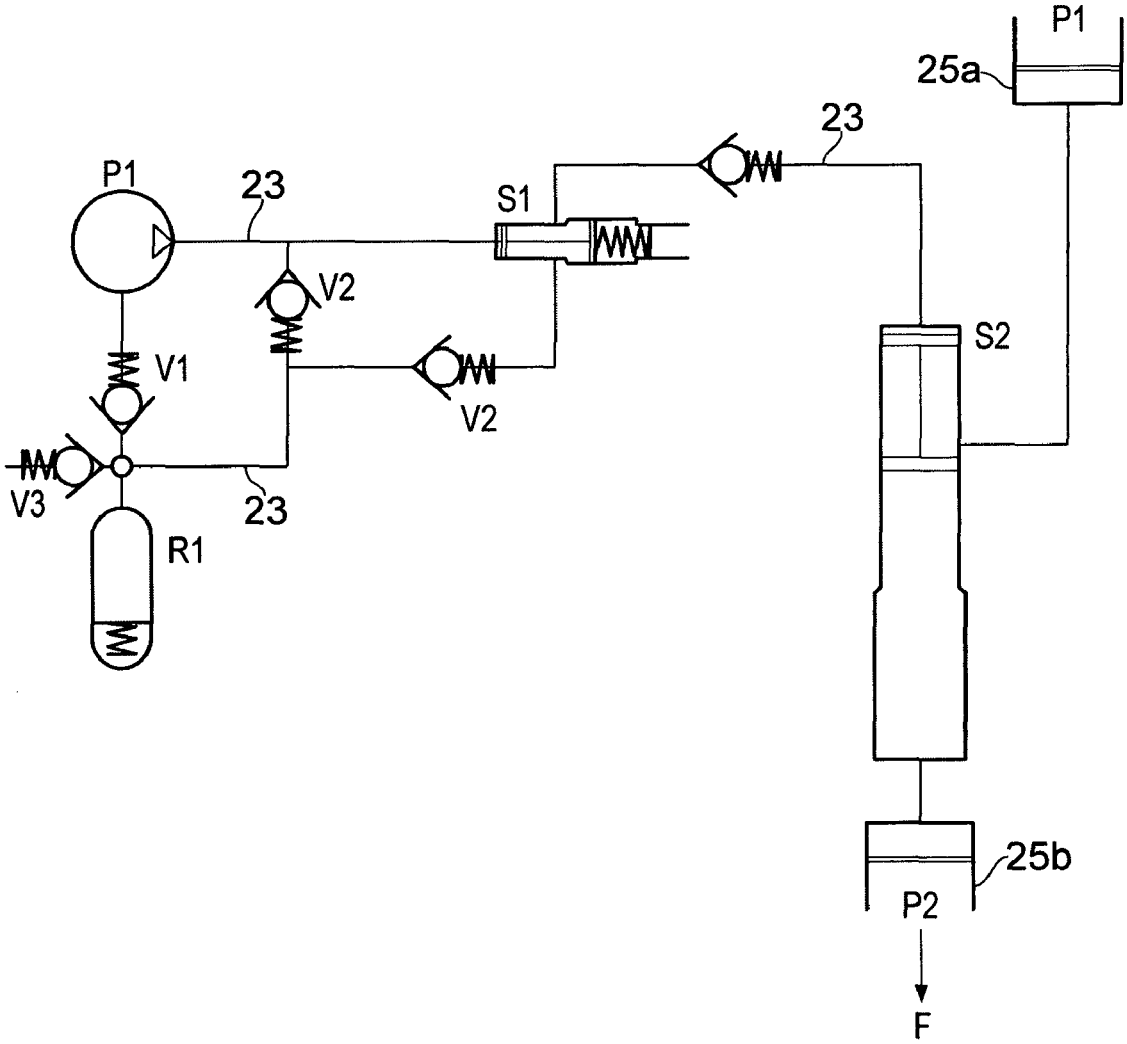
Figure 6:
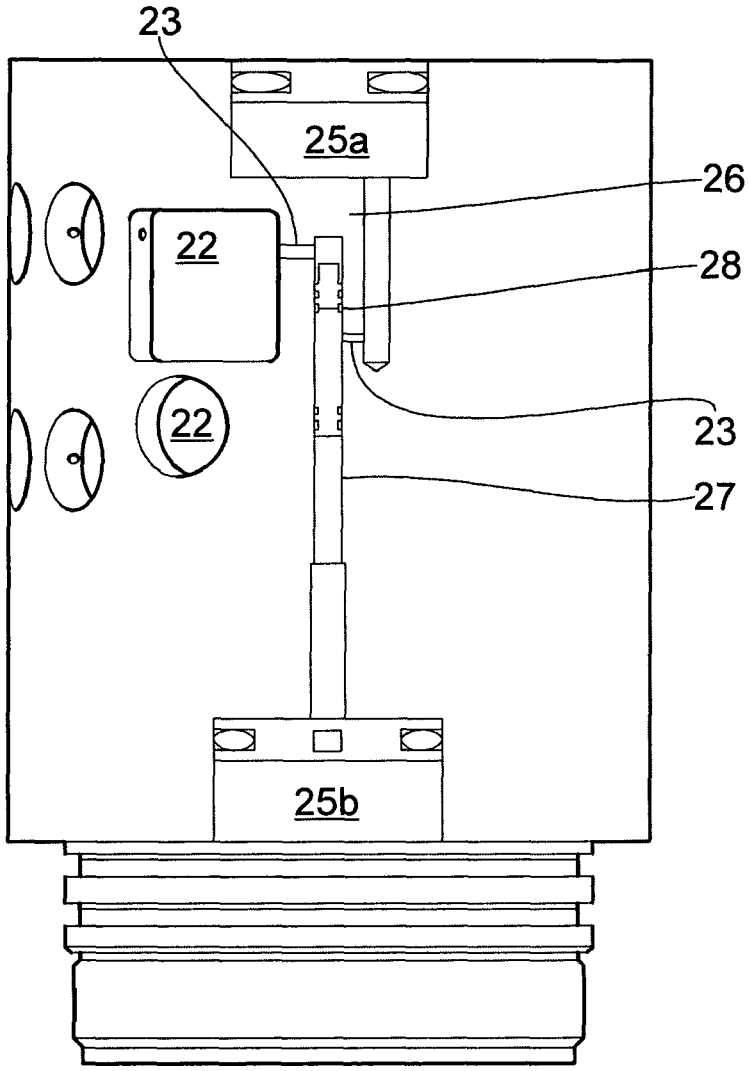
Figure 7:
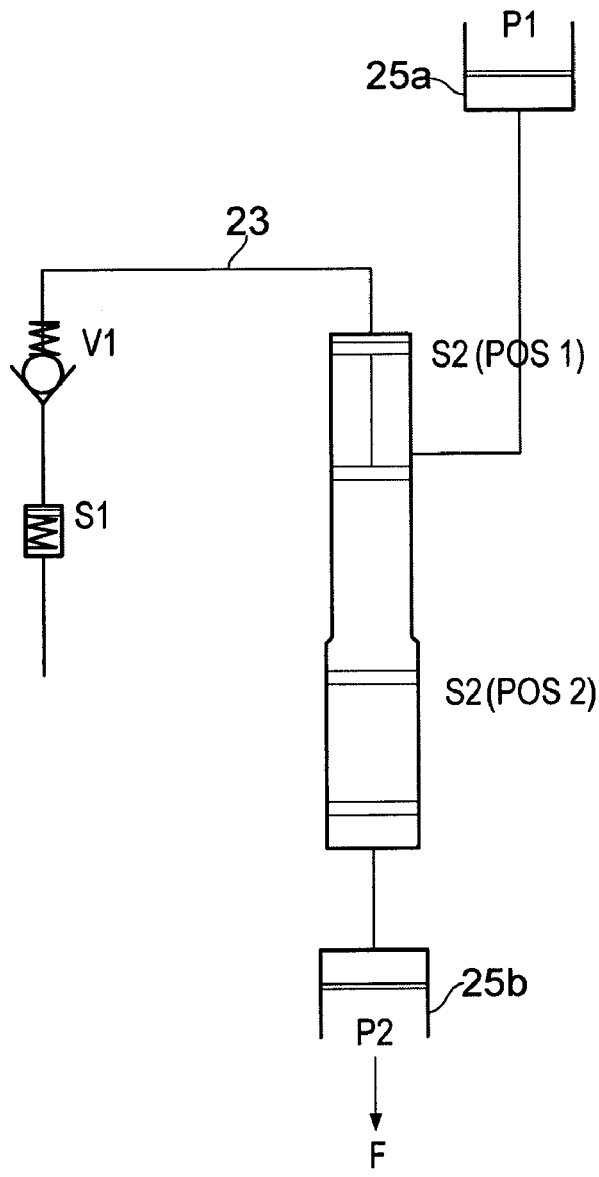

The invention will now be described in greater detail with reference to the following figures, in which:

FIG. 1 is a cross section of a well plug with which the activating mechanism according to the present invention can be connected, FIG. 2 is a perspective view of the activating mechanism according to the present invention, FIG. 3 illustrates a hydraulic circuit in the activating mechanism according to a first embodiment of the present invention, FIG. 4 illustrates a hydraulic circuit according to a second embodiment of the present invention, FIG. 5 illustrates a hydraulic circuit according to a third embodiment of the present invention, FIG. 6 illustrates further details of the activating mechanism according to the present invention, and FIG. 7 illustrates yet another hydraulic circuit according to a fourth embodiment of the present invention.

FIG. 1 illustrates a cross section of a well plug 100 with which an activating mechanism 200 (see FIG. 2) according to the present invention can be connected. The actual well plug 100 is mounted in a housing 1, which fits the plug 100 exactly. The plug 100 comprises a number of strata, comprising layered division of material strata, such as glass, ceramics and the like, together with a number of cavities arranged between the said material strata. In the figure a well plug is illustrated comprising three glass strata 5, 7, 9 and two intermediate cavities 16.

The well plug 100 comprises a sleeve-shaped element 19 comprising a number of supporting bodies 3, 6, 10, which are preferably annularly shaped, and which together enclose the glass strata 5, 7, 9 in the well plug 100 in the pipe's radial direction and longitudinal direction. In the exemplary FIG. 1 the supporting body 3 will constitute an upper supporting body, and the supporting body 10 will constitute a lower supporting body. The remaining supporting body 6 is mounted between the upper supporting body 3 and the lower supporting body 10 in the pipe's longitudinal direction. A packing body 11 is further provided on the lower side of the lower supporting body 10 in the pipe's longitudinal direction to ensure an exact fit in the plug's 100 housing 1.

The glass strata 5, 7, 9 are arranged at a distance apart. Between two adjacent glass strata there is provided a chamber 16, preferably a pressure support chamber. The chambers 16 may be filled with fluid such as water, oil or another suitable fluid, and have a given pressure. It should be noted that the respective chambers 16 may have different pressures in order to achieve the desired function with the device. It is advantageous for these chambers 16 to be filled with fluid before mounting the plug 100 in the tubing. Between the said supporting bodies 3, 6, 10 there are provided a number of outlets 8, where each chamber 16 comprises at least one outlet 8, for discharge of fluid from the chamber 16. The number of outlets 8 is kept closed by means of a body 2 such as a hydraulic slide valve. The body 2 is wholly or partly incorporated in the supporting bodies 3, 6, 10. This may be implemented, for example, by providing a recess in the supporting bodies, in which recess the body 2 is placed.

It is advantageous for first seals 15 to be mounted between the number of glass strata 5, 7, 9 and the respective supporting bodies 3, 6, 10 in order to prevent leakage between the chambers 16 in the areas where glass stratum and supporting body are in abutment. Similarly, it is advantageous for other seals 4 to be mounted in the respective supporting bodies 3, 6, 10 in order to prevent leakage in the areas where the different supporting bodies 3, 6, 10, 11 are in abutment.

According to the above-mentioned embodiment, a cavity 17 will be produced in the body's 2 area of movement when the body is mounted in the well plug. This cavity 17 permits movement of the body 2 in the well plug 100, and this movement triggers disintegration of the glass strata, which will be described in the following.

In the housing 1 there are provided a number of recesses 14 which can contain fluid discharged from the chambers 16 during the well plug's 100 disintegration phase. It is advantageous for the recesses 14 to have atmospheric pressure, and the recesses can therefore be filled with a compressible fluid such as air.

The well plug 100 goes from a closed (inactivated position) to an open position (activated position) when the body 2 is activated by an activating mechanism 200 (see FIGS. 2, 5). The body 2 will then be located in abutment with one or more pistons 25*b* in the activating mechanism's 200 lower end surface. In order for the well plug 100 to be activated, i.e. to activate disintegration of the glass strata, at a desired point of time by means of one or more pistons 25*b*, the activating mechanism 200 (see also FIG. 5) provides a pressure which is exerted against the body 2, thereby causing the body 2 to be moved a distance in the well plug's 100 axial direction, preferably a few millimetres. The body 2 will then be moved a distance which is sufficient for the sealing devices 13 which are mounted above and below the respective outlets 8 to also be moved downwards, thereby permitting fluid from the respective chambers 16 to be drained from the chambers 16 into the respective recesses 14.

It will automatically begin to leak out from the respective chambers 16 through the outlets 8 to the respective recesses 14 due to the pressure difference between the chambers 16 and the recesses 14. When fluid from the first chamber 16, i.e. the chamber 16 adjoining the glass stratum 5 which is placed closest to the external environment (the well environment), begins to leave the chamber 16 and is discharged through its outlet 8 into its recess 14, a pressure change will occur in the chamber 16, generating a pressure difference between the external environment and the pressure in the chamber. This will cause the glass stratum 5 to be bent and the glass stratum will finally break and shatter into a great many small particles. This assumes that the pressure difference between the chamber 16 and the external pressure is greater than the pressure that can be withstood by a glass stratum. Fluid from the tubing will then be supplied to the first chamber, so that the next glass stratum 7 will be influenced by the same pressure forces. In its movement the body 2 has opened the way for draining of all the chambers, with the result that the next glass stratum will also break due to a corresponding pressure difference between the external environment and the chamber below adjoining the second glass stratum 7. In this way the layers will break and disintegrate one by one, and this will continue until all the glass strata in the well plug 100 have disintegrated, and the plug 100 admits free through-flow of the fluid in the well.

In FIG. 2 the activating mechanism 200 is illustrated, comprising a sleeve 21, which in an embodiment may be annularly shaped, and is to be mounted close to or abutting the plug 100. The sleeve 21 may be made of any suitable material, which can withstand the pressure and/or temperatures as well as the corrosive environment found in the well. The surface (the material) of the sleeve 21 is provided with recesses 22, these recesses 22 being located round parts of or in the entire circumference of the sleeve 21. The recesses 22 may further be arranged in several layers or strata placed on top of one another, in a specific pattern etc., and between two adjacent recesses 22 there are further provided one or more through-going channels or bores 23, thereby interconnecting the two adjacent recesses 22. An upper row of the recesses 22, when viewed in the sleeve's 21 axial direction, is connected with one or more pistons 25*a* (see FIG. 5) which are mounted in an annular recess 24 in the upper edge of the sleeve 21 via at least one through-going channel 23 (not shown), and in a similar fashion the bottom row of the recesses 22 will also be connected with one or more pistons 25*b* in the lower edge of the ring via one or more channels 23 (not shown). This causes the sleeve's 21 pistons 25*a*, 25*b* to be interconnected through channels 23 and recesses 22. In this connection it should also be noted that the recesses 22 do not pass through the material of the sleeve 21. Pistons 25*a* will be exposed to the pressure (P1) in the well at the top of the well plug 100, while the pressure (P2) on the piston's 25*b* lower side may be around atmospheric pressure (in a non-activated state of the activating mechanism).

The recesses 22 may take any shape whatsoever, but in FIG. 2 they are shown with a circular and rectangular shape.

In these recesses 22 are mounted elements (not shown), where each element may be arranged to have a specific function or task. This may, for example, involve one element acting as a pump, a second may act as a piston, while a third permits fluid to flow in only one direction (non-return valve). By placing the individual elements in a specific order or pattern in the recesses 22, this means that a closed fluid circuit can be formed, where an external influence on this fluid circuit will result in a linear movement of a piston 25*a*, 25*b*. This linear movement may be utilised, for example, for activating a body 2 in a well plug 100, thereby enabling the glass strata in the well plug 100 to be disintegrated.

A first embodiment of such a fluid circuit is illustrated in FIG. 3, in which it can be seen that the circuit comprises a pump P1, where the pump P1 is connected via channels 23 with a piston S1 and a reservoir R1. The piston S1, the pump P1 and the reservoir R1 are provided as separate elements and each placed in a recess 22 in the sleeve 21. In the figure P1 refers to the well pressure, i.e. the pressure which the fluid on the top of the well plug has. The pump P1 will also be exposed to this pressure when the fluid is subjected to cyclical loads. P2 indicates the pressure which the pistons 25*b* have before the activating mechanism is in an open position.

Between the pump P1 and the reservoir R1 there is mounted a non-return valve V1 and a safety valve V5 for the reservoir R1. A flow control valve V2 furthermore connects the piston S1 and the reservoir R1. In this first part of the circuit, therefore, when the pump P1 is exposed to a cyclical load, a fluid supplied from the pump P1 will be fed to the piston S1, where this piston is arranged to supply an exact amount of fluid to a movable slide S2. When a full stroke is achieved in the piston S1, excess fluid will be returned to the reservoir R1 on account of the flow control valve V2. By means of the non-return valve V1, the fluid in reservoir R1 will also be able to supply fluid to the pump P1 when it goes in return. As mentioned, the piston S1 will be able to feed fluid into the movable slide S2 due to the fact that the piston S1 and the movable slide S2 are connected via a channel 23 and a non-return valve V4 for fluid from slide S2. The piston S1 and the slide S2 are also connected to a reservoir R2, where in a similar manner to the connection with the reservoir R1, a safety valve V6 is provided for the reservoir R2 and a non-return valve V3 for supply of fluid to the piston S1 when the piston S1 goes in return.

When the activating mechanism 200 has to be used for activating or deactivating subsea equipment or a downhole tool employed in connection with recovery of hydrocarbons, the fluid in, for example, a production tubing will be subjected to a number of cyclical pressure loads, which will "propagate" downwards in the tubing and the activating mechanism 200. Since these cyclical loads are substantial, the sleeve 21 will be expanded in its radial direction.

Due to the fact that the sleeve 21 is subjected to a number of cyclical loads, with each load the piston S1 will feed a specific amount of fluid into the movable slide S2, whereby each feed will move the slide S2 a distance in the sleeve's 21 axial direction. Eventually the slide S2 will have moved a specific distance, where the slide S2 is stopped from further movement and where in this position of the slide S2 a fluid connection is opened between the pistons 25*a* in the upper edge of the sleeve 21 and the pistons 25*b* in the lower edge of the sleeve 21. Since the pistons 25*a* in the upper edge of the sleeve 21 are exposed to the pressure P1 existing on the top of the well plug 100, this will cause the piston 25*a* to be pushed in in the sleeve's 21 axial direction, whereby fluid located on the piston's 25*a* lower side will flow through the channels 23 and on over the movable slide S2, thereby causing the piston 25*b* in the lower edge of the ring 21 to be pushed out in the sleeve's 21 axial direction. Since the piston 25*b*, which is connected to the body 2 in the plug 21, is moved, the body 2 will be activated and the glass strata shattered, as explained above.

In FIG. 4 an alternative embodiment of the fluid circuit according to FIG. 3 is illustrated, where it can be seen that an "auxiliary pump circuit" 30 is connected to the fluid circuit, where the "auxiliary pump circuit" 30 comprises a piston S3 and a pump P3. The pump P3 is mounted in a recess 22 in the sleeve 21, while the piston S3 is mounted so that it is located in direct contact with the well pressure P1 acting on the annular sleeve's 21 internal surface. In contrast to the above-described fluid circuit, the procedure with this alternative embodiment will be such that with each cyclical load a quantity of fluid will be supplied, where this fluid is delivered from the pumps P1 and P3. The pump P1 will then feed a certain amount of fluid to the piston S1 on account of the sleeve's radial expansion, while with each cyclical load the piston S3 will ensure that a pump P3 also feeds a certain amount of fluid to the piston S1. The rest of the circuit in this alternative embodiment will correspond to the fluid circuit as described above.

Another embodiment of the hydraulic circuit is illustrated in FIG. 5, where a pump P1 is connected to a cylinder S1 and a reservoir R1 via channels 23. Between the pump P and the reservoir R1 there is mounted a non-return valve V1 and a safety valve V3 for the reservoir R1. A flow control valve V2 further connects the piston S1 and the reservoir R1. The piston S1 is further connected to a movable slide S2, whereby the piston S1 will feed fluid to the movable slide S2. Cyclical loading on the fluid located in the tubing will cause the pump P1 to compress the piston S1, whereby a certain amount of fluid from the reservoir R1 will be supplied to the piston S1 via a non-return valve V2. When the cyclical loading has ceased, the pump P1 will go in return, whereby the piston S1 is relieved of the pressure and goes in return, where the fluid quantity now located in the piston S1 will be fed to the movable slide S2. On repeated loading the slide S2 will finally have moved a specific distance, thereby causing a connection to be opened between the pistons 25*a* in the upper edge of the sleeve 21 and the pistons 25*b* in the lower edge of the sleeve 21. This will cause the upper pistons 25*a*, which are exposed to a pressure P1 from a fluid located in the tubing and on the top of the well plug 100, to move the slide S2 in the sleeve's 21 axial direction, whereby the fluid located in the circuit will flow past the movable slide S2 and on to the top of the piston 25*b* in the lower edge of the sleeve 21. This will cause the piston 25*b* to be moved in the sleeve's 21 axial direction. Since the piston 25*b* is in contact with the body 2 in the well plug 100, the body 2 will be activated in a similar manner to the above, and the glass strata in the plug 100 will be shattered.

In FIG. 6 further details of the sleeve 21 are illustrated, where the pistons 25*a*, 25*b* are mounted in the recesses 24 in the upper and lower edge of the sleeve 21. The number of pistons 25*a*, 25*b* in the recess 24 in the upper and lower edge of the sleeve 21 may be identical, but it may also be envisaged that the whole recess 24 in the upper edge of the sleeve 21 forms a piston 25*a*, while four pistons 25*b* are mounted in the recess 24 in the lower edge of the sleeve 21.

The pistons 25*a*, 25*b* are interconnected via main channels 26, 27 extending in the sleeve's 21 axial direction together with connecting channels 23 provided in order to form a connection between the main channels 26, 27. Furthermore, one or more recesses 22 are also connected to the main channels 26, 27. When the sleeve 21 is exposed to a cyclical load, on account of the expansion of the sleeve 21 in a radial direction, a pump P which is mounted in a recess 22 will feed a quantity of fluid to a main channel 27 on the top of a movable slide S2 mounted in the main channel 27, thereby causing the movable slide S2 to be moved a specific distance in the sleeve's 21 axial direction. When the sleeve 21 has been subjected to a number of cyclical loads, the pump P will have delivered a specific amount of fluid to the main channel 27, with the result that the movable slide 28 has been moved a distance in the sleeve's 21 axial direction to a position where an open connection is created between the pistons 25*a* and the main channel 27. Since the pistons 25*a* in the upper edge of the sleeve 21 are exposed to a pressure P1 from the fluid located on the top of the well plug 100, this pressure P1 will cause the piston 25*a* to be moved in the sleeve's 21 axial direction, whereby the fluid located in the closed circuit is forced to flow past the movable slide S2, which is located in a fixed position, where the design of the slide S2 and the main channel 27 permits a through-flow. This causes the piston's 25*b* upper side to be influenced by this force and the piston 25*b* is moved in the sleeve's 21 axial direction. Since the piston 25*b* is in contact with the body 2 in the well plug 100, the piston's 25*b* movement will cause the body 2 to be rearranged to form a connection between the closed filled chambers 16 and the recesses forming the relief chamber, with the result that the fluid located between the well plug's 100 glass strata disappears and the glass strata are disintegrated.

FIG. 7 illustrates the construction of yet another closed hydraulic circuit for the sleeve 21 illustrated in FIG. 6, where a piston S1, when subjected to a load, feeds an exact amount of fluid to a movable slide S2. The piston S1 and the slide S2 are connected by a channel 23, where a non-return valve V1 is further provided on the channel 23. After a sufficient number of cyclical loads the slide S2 will have been moved to a position 2, which permits an influence of the piston 25*a* which is exposed to a well pressure P1. This well pressure P1 will then cause the piston 25*a* to be moved in the sleeve's 21 axial direction, with the result that fluid located in the piston 25*a* is fed to the slide S2, where the slide S2 permits the fluid located in the circuit to flow past. This causes piston 25*b* to be moved, whereby a body 2 in the well plug 100, which body is connected to the piston 25*b* in a suitable manner, can be activated.

For the sake of simplicity elements such as pump, reservoir and related valves are omitted from the figure. A person skilled in the art, however, will know how these components should be arranged in order to achieve the desired object, which is to create fluid connection between the pistons 25*a* and 25*b*.

The invention claimed is:

1. An activating mechanism for activating a downhole tool, comprising a sleeve having non-through-going recesses arranged in the material of the sleeve, said recesses being interconnected with one or more channels, at least one of said channels having an upper and a lower piston in fluid connection thereto arranged at opposite ends of the channel, said at least one channel further comprising a slide arranged therein, said slide having a first closing position and a second opening position, and further wherein a pump and a reservoir of a working fluid are arranged in one or more of the recesses and adapted to pump, in response to cyclic loads, the working fluid into the channel whereby the slide is moved from its closing to its opening position, in which opening position a fluid connection is opened up between the upper and the lower pistons, whereby movement of the upper piston is transmitted to the lower piston, said movement of the lower piston being arranged to operate the downhole tool.

2. The activating mechanism according to claim 1, wherein the reservoirs, pump, slide and pistons are produced as separate, replaceable units.

3. The activating mechanism according to claim 1, wherein the lower piston is in abutment with a body in a said downhole tool.

4. The activating mechanism according to claim 1, wherein with each cyclical load, said pump feeds a predetermined amount of working fluid to said movable slide.

5. The activating mechanism according to claim 1, wherein the sleeve is provided at its lower end with connection devices that permit interconnection with a said downhole tool.

6. The activating mechanism according to claim 1, wherein between the pump and the channel a flow control valve is mounted, whereby working fluid is returned to a reservoir.

7. The activating mechanism according to claim 1, wherein when subjected to cyclical loads the sleeve will be expanded in its radial direction.

8. The activating mechanism according to claim 1, wherein the channel has a first section having a first cross sectional area of approximately the same cross sectional area as the slide and a second section of a relatively greater cross sectional area, wherein, in its closing position the slide is arranged in the first section, and in its opening position the slide is arranged in the second section, whereby fluid from the upper piston is permitted to flow past the slide in this opening position.

9. The activating mechanism according to claim 1, wherein the reservoirs are pre-stressed.

10. A method for activating or deactivating a downhole tool, wherein the method comprises the following steps:

providing an activation device arranged to expand in its radial direction in response to cyclical fluid loads, said expansion arranged to activate a pump in the device, said pump being further arranged to pump a quantity of a working fluid to move a slide in the device from a closing to an opening position, thereby opening a fluid connection between an upper piston of the device, and a lower piston of the device, whereby movement of the upper piston is imparted upon the lower piston arranging the device in a tubing that contains a fluid, applying a plurality of cyclical loads to the fluid in the tubing, using the movement of the lower piston to activate or deactivate the downhole tool.

* * * * *